US006055782A

United States Patent [19]

Morton et al.

[11] Patent Number: 6,055,782

[45] Date of Patent: May 2, 2000

[54] EXTRUDED PLASTIC WINDOW FRAME WITH PERIPHERAL CHANNEL FOR RECEIVING EXTERIOR SIDING

[75] Inventors: Philip G. Morton, Germantown; David A. Stammen, Dayton; Michael T. Chaney, Middletown; Ricky Hoskins, Franklin, all of Ohio

[73] Assignee: Dayton Technologies, Inc., Monroe, Ohio

[21] Appl. No.: 09/073,029

[22] Filed: May 5, 1998

[51] Int. Cl.[7] ..... E06B 1/26

[52] U.S. Cl. ..... 52/204.1; 52/656.5; 49/504; 49/DIG. 2

[58] Field of Search ..... 52/204.1, 656.5; 49/504, DIG. 2

[56] References Cited

U.S. PATENT DOCUMENTS

| | | | |
|---|---|---|---|
| 2,763,344 | 9/1956 | Peterson | 52/656.5 X |
| 2,983,001 | 1/1961 | Guldager . | |
| 3,859,754 | 1/1975 | Budich et al. | 40/425 |
| 4,328,644 | 5/1982 | Scott et al. | 52/656.5 X |
| 4,407,100 | 10/1983 | Huelsekopf | 52/212 |
| 4,428,156 | 1/1984 | Malm et al. | 49/501 |
| 4,608,800 | 9/1986 | Fredette . | |
| 4,799,332 | 1/1989 | Haas | 49/408 |
| 4,924,628 | 5/1990 | Ruby et al. | 49/380 |
| 4,941,288 | 7/1990 | Morton . | |
| 5,003,747 | 4/1991 | Morton . | |
| 5,274,955 | 1/1994 | Dallaire et al. | 49/406 |
| 5,293,723 | 3/1994 | Slessor | 52/213 |
| 5,555,682 | 9/1996 | Colitto | 52/204.1 X |
| 5,660,010 | 8/1997 | Sayers . | |

FOREIGN PATENT DOCUMENTS

| | | | |
|---|---|---|---|
| 2537199 | 6/1984 | France | 52/204.1 |
| 406093771 | 4/1994 | Japan | 52/204.1 |
| 78009851 | 4/1980 | Netherlands | 52/204.1 |
| 83002849 | 3/1985 | Netherlands | 52/204.1 |
| 2194273 | 3/1988 | United Kingdom | 52/204.1 |
| 2274302 | 7/1994 | United Kingdom | 52/204.1 |
| 2275718 | 9/1994 | United Kingdom | 52/204.1 |

*Primary Examiner*—Carl D. Friedman
*Assistant Examiner*—Phi Dieu Tran A
*Attorney, Agent, or Firm*—Jacox, Meckstroth & Jenkins

[57] ABSTRACT

A window frame includes tubular sill, head and jamb members of extruded plastics material, and each member has laterally spaced inner and outer walls integrally connected by laterally extending transverse walls. A nailing flange projects laterally outwardly from each outer wall for securing the frame within a wall opening, and each frame member has an integral exterior portion projecting outwardly from the corresponding nailing flanges. The exterior portion of each frame member cooperates with an exterior transverse wall to define a groove or channel extending laterally inwardly from the outer wall for receiving the edge portion of exterior siding. Narrower frame members also have cavities within the interior transverse walls for receiving the edge portions of interior wood sill, head and jamb extenders.

16 Claims, 3 Drawing Sheets

EXTRUDED PLASTIC WINDOW FRAME WITH PERIPHERAL CHANNEL FOR RECEIVING EXTERIOR SIDING

BACKGROUND OF THE INVENTION

The present invention relates to hollow or tubular window frames of extruded plastics material and of the general type disclosed in U.S. Pat. No. 4,941,288 and U.S. Pat. No. 5,003,747 which issued to the Assignee of the present invention. In such a window frame, a pair of vertical jamb members are rigidly connected by a horizontal sill member and a horizontal head member, and each of the tubular members are formed by extruding a rigid plastics material such as polyvinylchloride (PVC). Preferably, the window frame is formed by mitering the opposite ends of the extruded linear frame members and then welding the mating mitered corners together to provide substantial rigidity.

The PVC frame may support a fixed picture window unit or one or more operable or movable window units, as shown in the above-mentioned patents. The frame is installed within a rough opening of a building wall, and sometimes the wall has an exterior surface covered by aluminum or PVC siding, usually in the form of lapped siding. After a window frame is positioned within the rough opening of a building wall, it is secured by nails or screws extending through a laterally outwardly projecting nailing flange extruded as an integral part of each frame member. When exterior siding is to be installed, it is common to install a separate J-channel around the exterior projecting portion of the window frame. The J-channel has a nailing flange portion which is attached to the building wall, a portion which covers the ends of the siding panels and a returned flange portion which overlies the end portions or edge portions of the siding panels.

A typical J-channel is disclosed in U.S. Pat. No. 4,608,800 and allows for longitudinal expansion and contraction of each siding panel while covering the expansion gap between the ends of the siding and the window frame. In factory manufactured housing units, it is known to construct a window frame with relatively flat extruded linear frame members and with an integrally extruded J-channel formed in part by the window frame nailing flange, for example, as disclosed in U.S. Pat. No. 5,660,010. A similar window frame construction is disclosed in U.S. Pat. No. 2,983,001. While the frame constructions disclosed in these patents may be acceptable for manufactured housing units, the frame structure would not be acceptable in site constructed homes where the window frame units must provide substantial strength, rigidity and an attractive appearance. It is also sometimes desireable for a window frame to provide for conveniently installing wood sill, head and jamb extenders within the interior of the building in order to provide a wood interior window frame for the window assembly or unit.

SUMMARY OF THE INVENTION

The present invention is directed to an improved frame for a window assembly and which is ideally suited for installation in a rough opening within a building wall which is to be covered by exterior siding panels. The window frame of the invention includes tubular sill, head and jamb members of extruded plastics material, and the frame members are joined together by mitered welded corners to form a rigid window frame for either an operable window unit or a fixed picture window unit. Each of the extruded sill, head and jamb members of the frame includes laterally spaced inner and outer walls integrally connected by laterally extending transverse walls, and each of the frame members has a rigid outwardly projecting exterior portion which define a peripheral cavity or channel for receiving the end or edge portions of exterior siding mounted on the building wall. The exterior projecting portions of the sill, head and jamb members also provide a neat and attractive appearance for the window assembly, and the exterior projecting portions do not interfere with access to the nailing flange for securing the window unit within the wall opening.

In accordance with preferred embodiments of the invention, the exterior projecting portions of the sill, head and jamb members forming the window frame, have laterally spaced walls which form a rigid and durable extension of the sill member and also form a rigid and decorative trim appearance for the head and jamb members. The recessed channel within each of the frame members is also formed by a double wall exterior flange which projects laterally outwardly in parallel spaced relation to an exterior transverse wall of the frame member. The interior transverse wall of each of the tubular sill, head and jamb members may also be formed with a longitudinally extending recess or cavity for receiving the edge portions of interior sill, head and jamb extenders in order to simplify the installation of interior wood extenders and provide the window assembly with a clean and neat interior appearance.

Other features and advantages of the invention will be apparent from the following description, the accompanying drawings and the appended claims.

DESCRIPTION OF THE PREFERRED EMBODIMENTS

Figure 1:
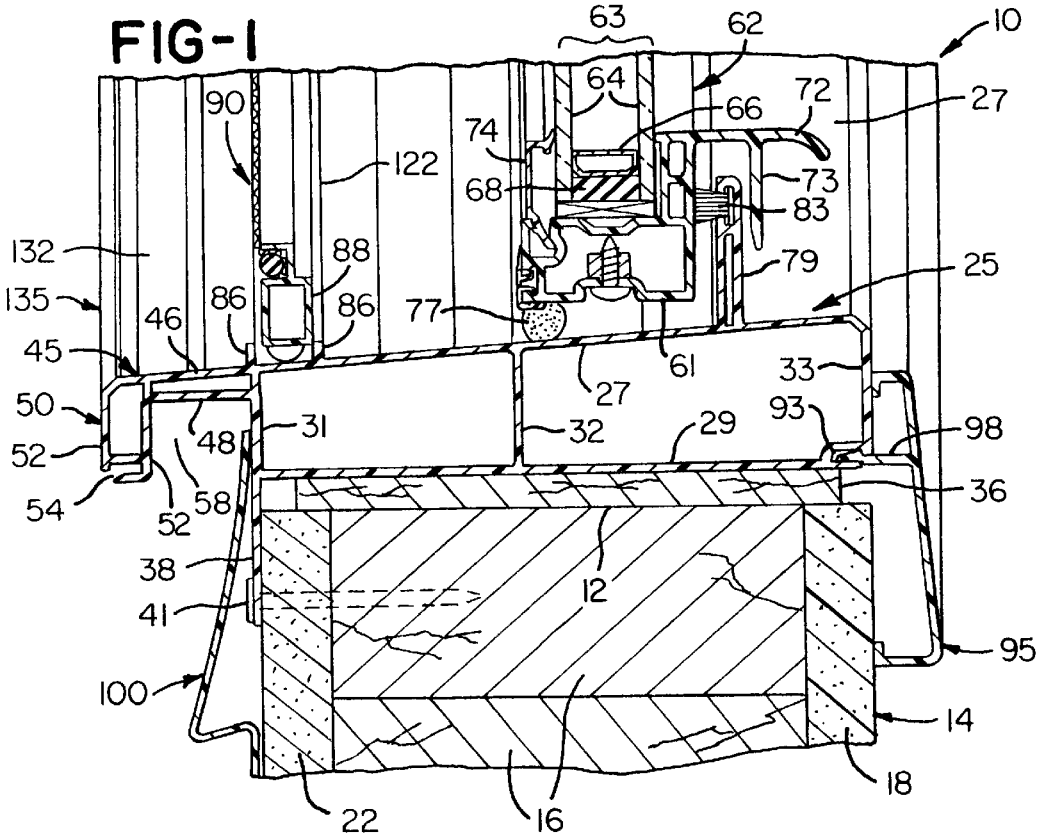
FIG. 1 is a fragmentary section of an installed operable window unit or assembly and showing a sill member constructed in accordance with the invention.

Referring to FIG. 1, an operable window assembly or unit 10 is shown installed in a rectangular rough opening 12 of a building wall 14 with the rough opening defined at the bottom by wood frame members 16. In a typical construction, the interior of the wall is formed by dry wall sheets 18, and the exterior surface of the wall is formed by exterior sheeting 22 also secured to the wall framing. The window unit 10 includes an elongated linear sill member 25 which is formed as a hollow or tubular extrusion, preferably of a rigid plastics material such as polyvinylchloride (PVC).

The sill member 25 includes a slightly inclined inner wall 27 which converges slightly with a generally parallel and laterally spaced outer wall 29. The walls 27 and 29 are integrally connected by laterally extending transverse walls 31, 32 and 33 to provide the sill member 25 with a hollow box-like rigid construction. The outer wall 29 of the sill member 25 rests upon a spacer or shim strip or pads 36 which are placed within the rough opening 12, and a nailing flange 38 projects laterally outwardly or downwardly for securing the sill member 25 of the window frame to the wall 14 by means of longitudinally spaced screws or nails 41.

The sill member 25 also includes an integrally extruded exterior portion 45 which is formed by laterally spaced double walls 46 and 48 which project outwardly from the exterior transverse wall 31 and support an integrally extruded box-like flange 50 having parallel spaced walls 52 and defining an accessory groove 54. The double wall flange 50 cooperates with the opposing transverse wall 31 and the projecting double walls 46 and 48 to define a longitudinally extending recess or channel 58 located laterally inwardly of the outer wall 29 of the sill member 25.

The operable window unit 10 shown in FIG. 1 is also illustrated with an extruded PVC sash member 61 which forms the bottom of a sash frame 62 having welded mitered corners and enclosing a glass unit 63 with dual glass panes 64 spaced by a metal spacer frame 66 and sealed together by a resilient rubber-like bonding material 68. The bottom sash member 61 has an interior projecting lift rail or handle 72 with a downwardly projecting flange 73, and the glass unit 63 is releasably retained within the sash frame 62 by a set of extruded plastic glazing members 74. A strip 77 of a resilient foam material is bonded to the bottom of the sash member 61 for engaging the top surface of the inner sill wall 27, and a double wall flange 79 is extruded as an integral part of the sill member 25 and projects upwardly from the inner wall 27 to support a flexible sealing strip 83 which contacts the bottom sash member 61. Preferably, the sill member 25 is also extruded with a pair of ribs 86 which project upwardly from the inner wall 27 and define a channel for receiving a frame 88 of a screen unit 90.

An accessory groove 93 (FIG. 1) is extruded within sill member 25 at the juncture of the outer wall 29 and the interior transverse wall 33, and an extruded plastic interior casing or trim member 95 has an intermediate leg portion 98 which projects into the groove 93 to form a snap-fit connection for retaining the trim member 95 against the sill member 25 and the adjacent dry wall sheet 18. As also shown in FIG. 1, the channel 58 within the sill member 25 receives the upper edge portion of exterior siding 100 which is illustrated in the form of extruded PVC lap siding. The exterior flange 50 of the sill member 25 covers or conceals the upper edge portion of the siding 100, and the channel 58 allows for vertical expansion and contraction of the siding.

Figure 2:
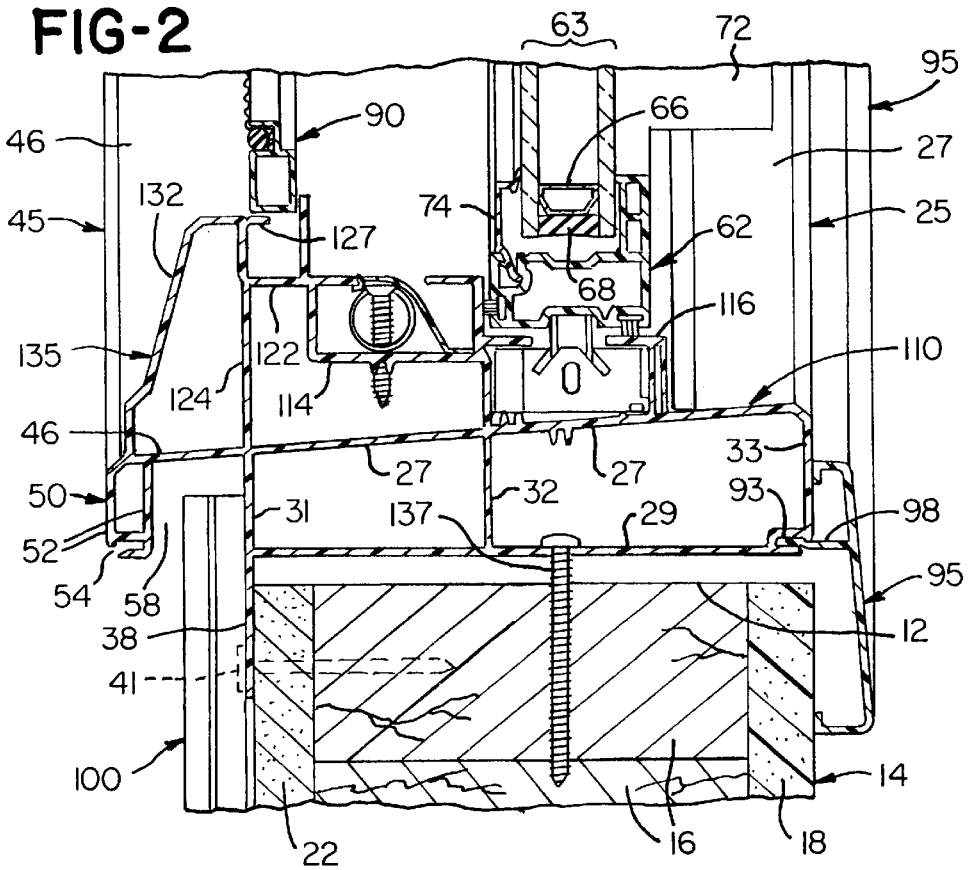
FIG. 2 is a fragmentary section similar to FIG. 1 and showing a jamb member for the operable window assembly.

Referring to FIG. 2, the frame of the window assembly or unit 10 includes a pair of vertical jamb members 110 and a head member (not shown) which has the same cross-sectional configuration as the jamb members 110. Since each jamb member 110 has an outer structure which is common with the sill member 25, the same reference numbers have been used for the same corresponding walls and components and also for the interior molding or trim member 95. Each jamb member 110 also includes a set of integrally extruded C-shaped channel portions 114 and 116 which provide guide rails or tracks for the lower vertically movable sash frame 62 and a similarly constructed upper sash frame (not shown). The channel portions 114 and 116 of each jamb member 110 also enclose conventional spring bias counterbalancing mechanisms (not shown) for each movable sash frame and the enclosed glass unit 63.

Each of the extruded head and jamb members 110 also include a U-shaped channel portion 122 which is connected to the inner wall 27 by a laterally extending wall 124 in plane with the exterior transverse wall 31. The channel portion 122 within each jamb member 110 is partially closed by a frangible rib or flange 127 for laterally locating the frame 88 of the screen unit 90. The flange 127 is broken off within the head member (not shown) so that the channel portion 122 may receive the top frame member of the screen unit 90 for retaining the screen unit. The channel portion 122 of each head and jamb member 110 is also integrally connected to the corresponding double wall flange 50 of the exterior portion 45 by an exterior trim wall 132. The wall 132 cooperates with the walls 46 and 124 to form a rigid tubular exterior portion 135 for the jamb and head members. By replacing the wall 48 of the sill member 25 with the laterally spaced trim wall 132 of each jamb member 110, the channel 58 within each jamb member is somewhat deeper in order to provide for greater longitudinal expansion of the vinyl siding 100 having end portions projecting into the channel 58 within each jamb member 110. As also shown in FIG. 2, the rectangular window frame formed by the sill, head and jamb members with welded mitered corners, is positioned laterally or horizontally within the rough opening 12 by a set of screws 137 which connect the outer walls 29 of the jamb members to the adjacent wood frame members 16.

Figure 3:
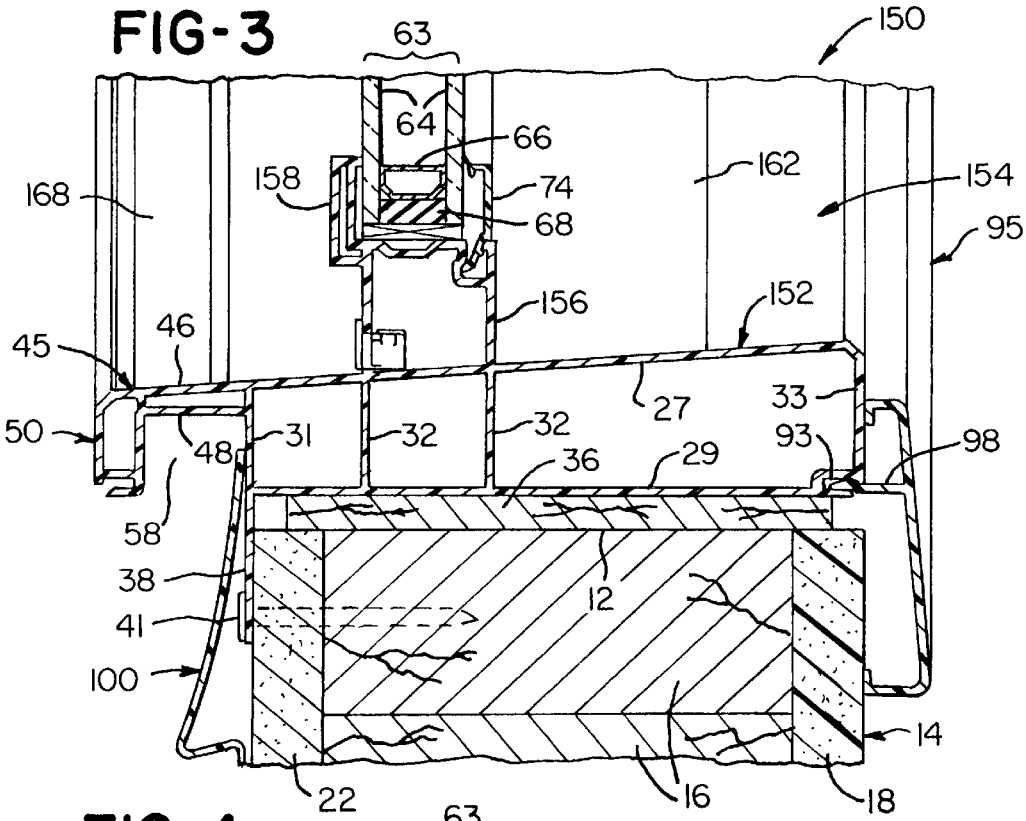
FIG. 3 is a fragmentary section of an installed picture window assembly and showing a sill member constructed in accordance with the invention.
Figure 4:
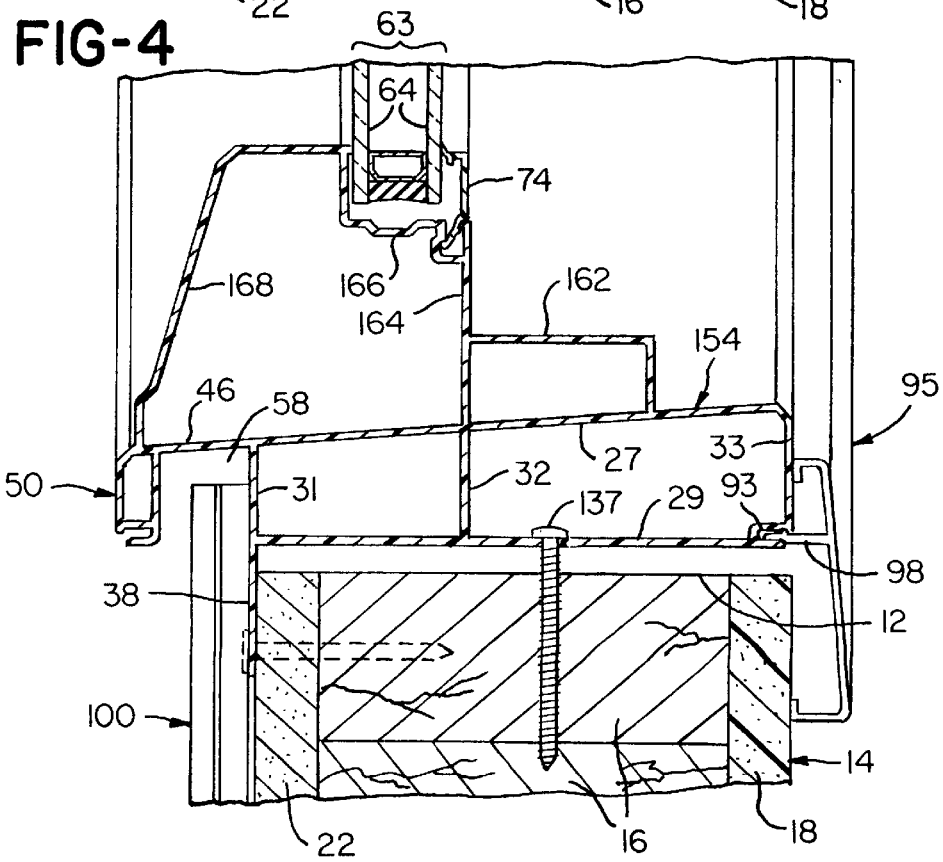
FIG. 4 is a fragmentary section similar to FIG. 3 and showing a jamb member or the picture window assembly.

FIGS. 3 and 4 show a sill and jamb construction in accordance with the invention of a rectangular frame for a fixed picture window assembly or unit 150. The frame includes an extruded rigid PVC sill member 152 (FIG. 3) and a pair of jamb members 154 (FIG. 4). The head member of the frame has the same cross-sectional profile as each of the jamb members 154, and each of the sill, head and jamb members of the window unit 150 have walls and components corresponding to those of the frame members 25 and 110 of the operable window unit 10 described above in connection with FIGS. 1 and 2. Accordingly, the common walls and components are identified with the same reference numbers.

In reference to FIG. 3, the extruded sill member 152 also includes an integrally extruded and laterally inwardly projecting box-shaped portion 156 which forms a support for the glazing or glass unit 63. The glass unit 63 is confined between an integrally extruded double wall flange 158 and a removable extruded glazing bead 74. Each of the jamb members 154 includes an integrally extruded L-shaped wall 162 (FIG. 4) which connects the inner wall 27 to integrally extruded walls 164, 166 and 168 which connect the middle of the inner wall 27 to the exterior double wall flange 50. The wall 166 forms a recess or cavity for receiving the glass unit 63 which is retained by the removable glazing bead 74.

The contour of the exterior wall 168 and the walls 156 and 158 provide for matching the appearance of the fixed window unit 150 with the appearance of an adjacent operable or double hung window unit 10 and also provide for locating horizontal mullions or grid members for the glass unit 63 of the fixed window assembly 150 on the same level as the horizontal mullions or grid members within the operable or double hung window assembly 10. The wall 168 also reinforces the projecting wall 46 and thereby adds substantial rigidity to the exterior portion 135 and flange 50 which define the channel 58.

Figure 5:
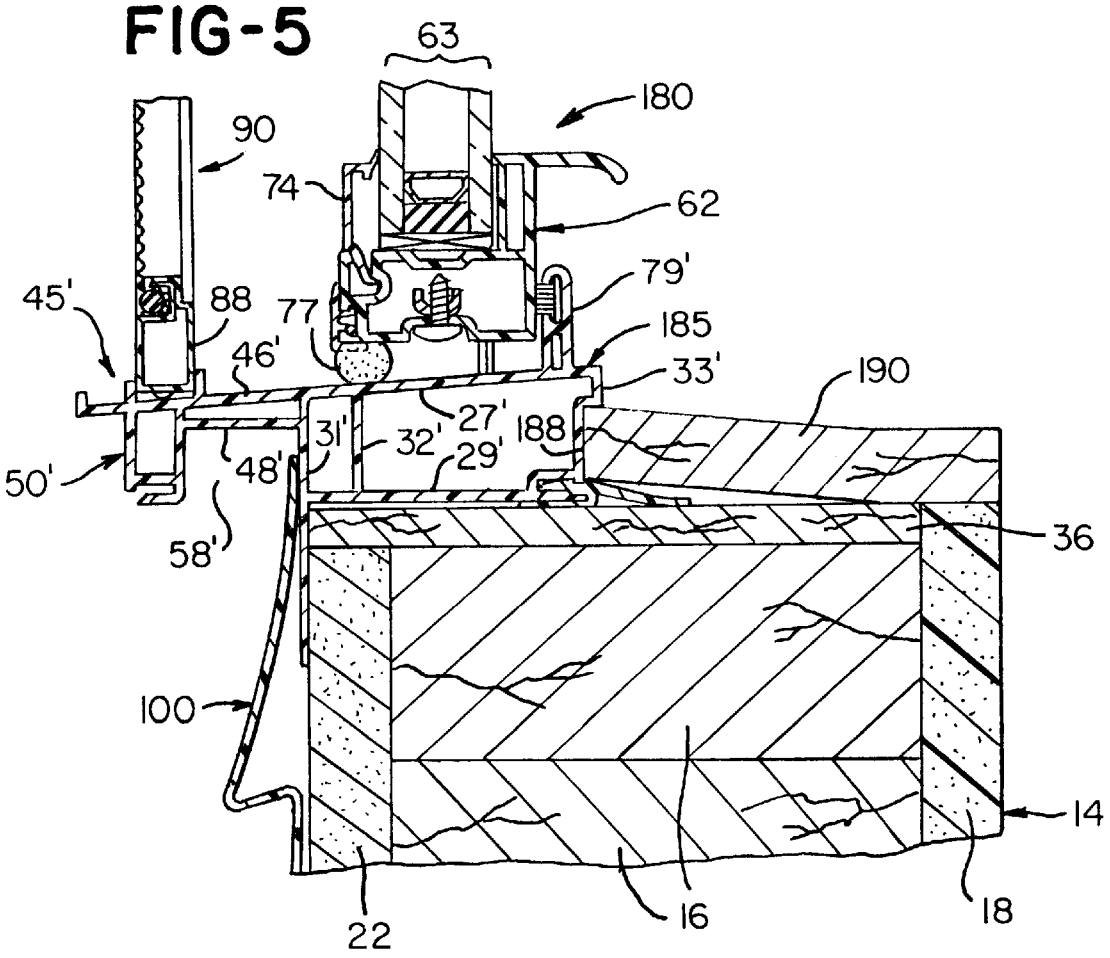
FIG. 5 is a fragmentary section of a sill member of an operable window assembly constructed in accordance with a modification of the invention.

Referring to FIG. 5, an operable window assembly or unit 180 includes an elongated extruded PVC sill member 185 which is constructed substantially the same as the sill member 25 (FIG. 1) except that the sill member 185 is substantially narrower in width than the sill member 25. Accordingly, the components and walls of the window unit 10 shown in FIG. 5 are identified with the same reference numbers as used above to identify the corresponding components and walls except with the addition of a prime mark on each reference number.

In the embodiment shown in FIG. 5, the interior transverse wall 33' defines a longitudinally extending recess or cavity 188 for receiving the edge portion of a wood sill extender 190. The cavity 188 conceals the inner edge portion of the extender 190 and provides for quick and convenient installation as well as a neat appearance for the joint between the sill member 185 and the wood sill extender 190. It is understood that the head and jamb members for the window unit 180 shown in FIG. 5 are also extruded with a narrow width profile and have corresponding cavities for receiving similar wood jamb and head extenders similar to the wood sill extender 190.

From the drawings of the above description, it is apparent that a window unit including a frame constructed in accordance with the present invention, provides desirable features and advantages. For example, the cross-sectional configuration of the sill members 25 and 152 and the jamb members 110 and 154 provide for producing a rigid rectangular frame since the inner walls 27 and the outer walls 29 and the transverse walls 31–33 all have a common profile and may be welded together at mitered corners. In addition, all of the sill, head and jamb members have common double wall flanges 50 and projecting walls 46 which are welded at the corners, and the additional wall 48 and 48' on the sill members 25, 152 and 185 provide additional strength for the exterior sill portion 45 and 45' of the sill member. As another feature, the exterior trim walls 132 and 168 provide reinforcement and additional strength and rigidity to the projecting exterior portions of the jamb and head members and provide the appearance of a brick molding.

The peripheral recessed cavity or channel 58 within the frame members further provides full access to the nailing flanges 38 around the window frame for securing the frame to the building wall 14 while the channel 58 also provides for receiving and concealing the edge portions of the exterior siding 100 around the frame. Additional features are provided by the width of the frame between the nailing flanges 38 and the plane of the interior transverse walls 33 being the same as the width of the wall 14, and the interior groove 93 adjacent the outer wall 29 of each frame member for receiving the leg portion 98 of the corresponding interior casing or trim member 95. A further feature is provided by the recess cavity 188 (FIG. 5) formed within the interior transverse wall 33' of the sill member 185 and in each jamb and head member for receiving the edge portions of corresponding wood frame extenders such as the sill extender 190. This feature simplifies the installation of the wood frame extenders when desired for the interior of the window opening.

While the forms of window frame herein described constitute preferred embodiments of the invention, it is to be understood that the invention is not limited to these precise forms, and that changes may be made therein without departing from the scope and spirit of the invention as defined in the appended claims.

What is claimed is:

1. In combination with a building wall having an inner surface and an exterior surface and defining a window opening receiving a frame of a window assembly, said frame comprising an elongated sill member of extruded plastics material and connecting a pair of elongated jamb members of extruded plastics material, each of said sill and jamb members including longitudinally extending and laterally spaced inner and outer walls connected by longitudinally extending transverse walls generally perpendicular to said inner and outer walls, each of said sill and jamb members including an exterior portion projecting outwardly from said exterior surface of said building wall and cooperating with an exterior said transverse wall to define a channel within said exterior portion facing laterally outwardly adjacent said exterior transverse wall and laterally aligned with said exterior surface of said building wall, said channels of said sill and jamb members extending laterally inwardly of said outer walls of said sill and jamb members and laterally inwardly of said window opening, and said channels having substantial depth into said exterior portions of said sill and jamb members from said outer walls to receive edge portions of exterior siding mounted on said exterior surface of said building wall with the edge portions of the siding projecting laterally inwardly of said window opening.

2. A frame as defined in claim 1 wherein said exterior portion of said sill member includes laterally spaced walls projecting generally perpendicular outwardly from said exterior transverse wall to form a continuation of said inner wall of said sill member, and a flange wall projecting laterally outwardly from said laterally spaced walls and cooperating with said exterior transverse wall to define said channel.

3. A frame as defined in claim 1 wherein said exterior portion of each said jamb member comprises a first wall projecting outwardly from said exterior transverse wall, an exterior trim wall projecting laterally inwardly from said first wall for reinforcing said first wall, a flange wall projecting laterally outwardly from said first wall and said trim wall and cooperating with said exterior transverse wall to define said channel, and said trim wall having a bottom end mating with said inner wall of said sill member.

4. A frame as defined in claim 1 wherein each of said jamb members includes integrally extruded guide walls projecting laterally inwardly from the corresponding said inner wall and defining guideways for a movable glass sash frame, and said exterior portion of each said jamb member includes an exterior trim wall having a bottom end mating with said inner wall of said sill member.

5. A frame as defined in claim 1 wherein each of said sill and jamb members includes integrally extruded mating walls projecting laterally inwardly from the corresponding said inner wall and defining a recess for receiving a glass picture window unit, and said exterior portion of each said jamb member includes an exterior trim wall having a bottom end mating with said inner wall of said sill member.

6. A frame as defined in claim 1 wherein said inner wall of each of said sill and jamb members slopes slightly towards the corresponding said outer wall, and each said exterior portion including a double wall flange cooperating with said exterior transverse wall to define said channel.

7. A frame as defined in claim 1 wherein an interior said transverse wall of said sill member defines a longitudinally extending cavity between the corresponding said inner and outer walls and adapted for receiving an edge portion of a wood sill extender.

8. A frame as defined in claim 1 wherein said exterior portion of said sill member includes laterally spaced walls projecting generally perpendicular outwardly from said exterior transverse wall to form a continuation of said inner wall of said sill member, and a double wall flange projecting laterally outwardly from said laterally spaced walls and cooperating with said exterior transverse wall to define said channel.

9. A frame as defined in claim 1 wherein said exterior portion of each said jamb member comprises a first wall projecting outwardly from said exterior transverse wall, an exterior trim wall projecting laterally inwardly from said first wall for reinforcing said first wall, and a double wall flange projecting laterally outwardly from said first wall and said trim wall and cooperating with said exterior transverse wall to define said channel.

10. A frame as defined in claim 1 wherein each of said sill and jamb members includes an accessory groove disposed adjacent the corresponding said outer wall and an interior said transverse wall, and an extruded interior trim strip including an intermediate leg portion projecting into each said groove of said sill and jamb members in snap-fit engagement.

11. A frame as defined in claim 1 wherein the width of said frame as defined between the plane of said exterior transverse walls and the plane of the interior said transverse walls is substantially the same as the width of said building wall as defined between said inner surface and said exterior surface.

12. A frame as defined in claim 1 wherein each of said jamb members comprises an extrusion of plastics material and includes integrally extruded walls defining a groove adapted to receive the frame of a screen unit, and a frangible and removable rigid flange projecting into said groove for positioning the screen unit laterally between said jamb members and to permit using said extrusion as a head member connecting said jamb members after said flange is removed.

13. In combination with a building wall having an inner surface and an exterior surface and defining a window opening receiving a frame of a window assembly, said frame comprising an elongated sill member of extruded plastics material and connecting a pair of elongated jamb members of extruded plastics material, each of said sill and jamb members including longitudinally extending and laterally spaced inner and outer walls connected by longitudinally extending transverse walls generally perpendicular to said inner and outer walls, each of said sill and jamb members including an exterior portion projecting outwardly from said exterior surface of said building wall and cooperating with an exterior said transverse wall to define a channel within said exterior portion facing laterally outwardly adjacent said exterior transverse wall and laterally aligned with said exterior surface of said building wall, a nailing flange projecting laterally outwardly from said outer wall and said exterior transverse wall of each of said jamb members and securing said frame to said exterior surface of said building wall, said channels of said sill and jamb members extending laterally inwardly of said outer walls of said sill and jamb members and laterally inwardly of said window opening, and said channels having substantial depth into said exterior portions of said sill and jamb members from said outer walls to receive edge portions of exterior siding mounted on said exterior surface of said building wall with the edge portions of the siding projecting laterally inwardly of said window opening.

14. A frame as defined in claim 13 wherein said inner wall of each of said sill and jamb members slopes slightly towards the corresponding said outer wall, and each said exterior portion including a double wall flange cooperating with said exterior transverse wall to define said channel.

15. A frame as defined in claim 13 wherein an interior said transverse wall of said sill member defines a longitudinally extending cavity between the corresponding said inner and outer walls and adapted for receiving an edge portion of a wood sill extender.

16. A frame as defined in claim 13 wherein each of said sill and jamb members includes an accessory groove disposed adjacent the corresponding said outer wall and said interior transverse wall, and an extruded interior trim strip including an intermediate leg portion projecting into each said groove of said sill and jamb members in snap-fit engagement.

* * * * *